US005992630A

United States Patent [19]

Brown et al.

[11] Patent Number: 5,992,630

[45] Date of Patent: Nov. 30, 1999

[54] SHRINK WRAP PACKAGE

[75] Inventors: Arnold Brown, Owings Mills; Edward John Giblin, Finksburg, both of Md.

[73] Assignee: Lever Brothers Company, New York, N.Y.

[21] Appl. No.: 08/861,254

[22] Filed: May 21, 1997

[51] Int. Cl.[6] ..... B65D 75/00

[52] U.S. Cl. ..... 206/497; 229/120

[58] Field of Search ..... 206/497, 526; 220/367.1; 229/120

[56] References Cited

U.S. PATENT DOCUMENTS

| | | | |
|---|---|---|---|
| Re. 27,212 | 11/1971 | Brown | 206/432 |
| 3,026,656 | 3/1962 | Rumsey, Jr. . | |
| 3,416,288 | 12/1968 | Coons . | |
| 3,589,510 | 6/1971 | Begnaud et al. . | |
| 3,693,788 | 9/1972 | Oglesbee . | |
| 3,756,397 | 9/1973 | Ganz | 206/432 |
| 3,804,235 | 4/1974 | Anderson . | |
| 3,878,943 | 4/1975 | Ryan et al. | 206/497 |
| 3,918,584 | 11/1975 | Richardson | 206/497 |
| 3,972,131 | 8/1976 | Rudy et al. . | |
| 3,990,576 | 11/1976 | Heaney | 206/497 |
| 4,012,326 | 3/1977 | Rudy et al. . | |
| 4,177,895 | 12/1979 | Shelton | 53/442 |
| 4,238,531 | 12/1980 | Rudy et al. . | |
| 4,289,237 | 9/1981 | Cutrara | 206/443 |
| 4,306,653 | 12/1981 | Fales | 206/497 |
| 4,327,133 | 4/1982 | Rudy et al. . | |
| 4,421,792 | 12/1983 | Rudy et al. . | |
| 4,730,730 | 3/1988 | Clarkson | 206/432 |
| 4,815,603 | 3/1989 | Harris | 206/497 |
| 4,828,110 | 5/1989 | Lems | 206/432 |
| 4,873,814 | 10/1989 | Harris | 53/442 |
| 4,941,572 | 7/1990 | Harris | 206/497 |
| 5,002,782 | 3/1991 | Oberle | 206/497 |
| 5,171,593 | 12/1992 | Doyle | 206/497 |
| 5,305,881 | 4/1994 | Caldwell et al. . | |
| 5,310,057 | 5/1994 | Caldwell et al.. . | |
| 5,577,612 | 11/1996 | Chesson et al. . | |

OTHER PUBLICATIONS

The Wiley Encyclopedia of Packaging Technology, John Wiley & Sons, pp. 335–338.

*Primary Examiner*—Jim Foster
*Attorney, Agent, or Firm*—Gerard J. McGowan, Jr.

[57] ABSTRACT

A packaged product comprising a plurality of individual containers, a corrugated board or paperboard carrier wall disposed along a portion of the periphery and shrink wrapping. The shrink wrap film has vent holes that are specifically sized and spaced apart as needed to provide adequate venting of one or more volatiles out of the shrinkwrapped multi-pack to prevent package staining and/or discoloration of the package's printing inks. The container wall preferably has an open top and bottom and also has two free edges spaced from each other so as to leave a portion of the periphery uncovered by the wall.

27 Claims, 2 Drawing Sheets

SHRINK WRAP PACKAGE

BACKGROUND OF THE INVENTION

Generally, consumer product packages such as cartons or bottles are shipped from the manufacturer to the retailer in a shipping case. In some situations the shipping case is specially designed so that a portion may be readily removed to facilitate display of the product in the case. Certain shipping cases even permit viewing of the product without removal of a portion of the shipping case.

It is important that a shipping case provide adequate protection to the packages so that the product is not damaged in transit. Particularly important is that the shipping case have adequate compressive strength so that when cases are loaded one on top of another the weight of the upper case is supported by the lower case without any damage to the packages in the cases.

A further problem attendant to the design of modern shipping cases is the desire for reduction of resource used in the fabrication of the case. Not only does this reduce the cost of the case, but it minimizes the amount of waste material which must be disposed of when the mission of the case has been fulfilled. However, it is not an easy task to meet the dual goals of providing significant source reduction and at the same time affording adequate protection to the packages housed within the case.

Shrinkwrapped packaging is well known. However, it has been found that when shrink wrapped packaging is employed for cartons containing volatile components such as perfumes, staining and/or printing ink discoloration of the cartons can occur. Numerous patents discuss shrink wrapping.

Harris, U.S. Pat. No. 4,873,814 discloses a shrinkwrap package including vent openings of a size and number to permit free air flow through the package and allow the escape of gas. The container is for produce and other comestibles and is said to lengthen the life of such products by permitting a free flow of air through the package, thereby discouraging the formation of mildew and preventing the buildup of moisture which causes spoilage. The patent explains that the disadvantage of effectively encasing produce such as fruit and the like in a sealed container of air is that it results in a shortened shelf life. Fruit, for example, generates ethylene which promotes accelerated ripening. Fruit, candies, cheeses, liqueurs and the like are mentioned.

Harris, U.S. Pat. No. 4,815,603 issued from the parent application to the application which issued as U.S. Pat. No. 4,873,814 mentioned above.

Rumsey, U.S. Pat. No. 3,026,656 is directed to an improved commercial package wrapped in sheet material and an improved method and apparatus for making the same wherein the air or a substantial proportion thereof is removed in an improved and effective manner and the package is thereupon effectively sealed so that air will not reenter the package at the point of extraction. The patent mentions that food products are frequently packaged in transparent sheet material and it is has been found that by removing the air or a large portion thereof from the package the product will be protected and preserved for a relatively longer period of time. The Rumsey patent indicates that packages embodying the invention may be used for many different types of products, but particularly products such as food products which are protected and preserved for longer periods of time when the air or at least a portion of the air is removed from the package. Thus the invention, it is said, may be used for the packaging of meat products of various types, dairy products such as cheese or butter and the like.

Anderson, U.S. Pat. No. 3,804,235 is directed to a package having a sheet of heat shrinkable material wrapped therearound wherein the sheet of heat shrinkable material has at least one opening. An object is a pilfer-proof package having holes therein which have ribbed reinforcements that are tightly held against and contiguous to the packages to prevent air circulation. Packaging of, e.g., cigarettes is mentioned.

Cutara, U.S. Pat. No. 4,289,237 is directed to a fire wood package having a film of plastic material secured around the bundle of firewood. Both ends of the bundle are exposed and the plastic material is perforated to permit air to circulate into and through the bundle by way of the perforations and open ends of the bundles.

Fales, U.S. Pat. No. 4,306,653 is directed to a packaging container for protection of fragile articles. Lamps, objects d'art, motors and furniture are mentioned. A heat shrinkable inner packing may be used. In FIG. 1, shrink bag 60 appears to include holes.

Oberle, U.S. Pat. No. 5,002,782 discloses heat shrinkable thermoplastic bags including slits cut by a knife blade. The slits are said to reduce the splitting when a product, such as a meat product, is cooked within the bag. The baking or roasting of turkey breast, ham or the like is mentioned.

Doyle, U.S. Pat. No. 5,171,593 is directed to a method of wrapping a tray of produce or other articles requiring ventilation. The sheet includes a perforated portion which is bounded by non-perforated lateral edge portions. Plastic film packaging of produce such as blueberries and raspberries is mentioned.

Harris, U.S. Pat. No. 4,941,572 is directed to a package for shipping and storing articles such as cut flower arrangements. Use of the package of the Harris invention for shipping potted plants is also mentioned. A plastic film cover is employed which is formed from shrinkwrapped plastic and includes an upper vented portion and a lower portion wrapped around the container in shrinkwrap relation.

A number of different types of cases and other shipping packages are known in the literature.

Richardson, U.S. Pat. No. 3,918,584 is directed to a shipping case for fragile product-filled cartons made from a rectangular sleeve of corrugated fiberboard having open ends and having the corrugation running between the open ends. A plurality of cartons are stacked in rectangular configuration in the sleeve and occupy the entire volume of the sleeve with exposed carton faces forming a substantial planer surface at both ends of the sleeve. Heat shrinkable transparent film in the form of a band is disposed around the open ends of the fiberboard sleeve and at least two opposite walls of the sleeve and is shrunk. The sleeve and carton are contained together as an integral unit providing a shipping case without end flaps.

In Richardson, the vertical compressive or end strength is said to be unexpectedly superior to that of conventional filled cases, thereby enabling, if desired, the use of lower weight packing materials with attendant cost savings. Moreover, the lack of flaps in the Richardson construction is said to minimize fatigue or damage since it is said virtually to be impossible to maintain the case in a square configuration as the flaps are being glued closed. The visibility of the cartons through the transparent overwrap is said to make less likely damaging or cutting of the cartons when the case is open.

Lehms, U.S. Pat. No. 4,828,110 is directed to a unitized package of a plurality of generally cylindrical containers such as cans or bottles. The unitized package comprises several independent integral container cells of equal size held together to one another by a resilient film ribbon under tension. The film ribbon may be oriented polypropylene. Optionally, each container cell may be circumscribed by a band, such as plastic strips 28, 30 and 32. The resilient film ribbon of Lehms is in contact with the containers about the periphery of the package along a major portion, i.e. more than 50% of the cylindrical body portion length dimension.

Ryan et al., U.S. Pat. No. 3,878,943 is directed to a rectangular shipping package comprising a carton having at least five sides enclosed within a shrunken packaging film.

Oglesbee, U.S. Pat. No. 3,693,788 is directed to a package designed to pack and distribute articles such as glass tumblers, having an inner paperboard sleeve and an outer envelope such as a shrink film envelope. The sleeve has one or more flexible curved article gripping panels formed by the use of curved scorelines.

Heaney, U.S. Pat. No. 3,990,576 is directed to an arrangement for packaging glass doors and the like for shipment and handling. The bundle of glass doors is wrapped in a packing strip, which is cinched to a pallet and covered with a transparent film, preferably by heat shrinking a clear plastic envelope therearound.

Brown, U.S. Pat. No. RE.27,212 is directed to package constructions having open ended receptacle means filled with product containers arranged in rows and disposed in a heat shrunk film-like member holding the receptacle means and product containers tightly together. A plurality of receptacle means can be disposed in stacked relation within the heat shrunk tubular film-like member.

Coons, U.S. Pat. No. 3,416,288 is directed to a method of shrink packaging utilizing a self-erecting pallet.

Begnaud et al., U.S. Pat. No. 3,589,510 is directed to a package comprising a tray having four vertical sides and a bottom, contents in the tray and a shroud extending over the contents.

Clarkson, U.S. Pat. No. 4,730,730 is directed to a tray for supporting a plurality of bottles and a band around the perimeter of the bottles. A shrink wrap is placed around the bottles, band and tray.

Ganz, U.S. Pat. No. 3,756,397 discloses a single wrap of a single sheet of continuous shrinkable plastic material to constitute virtually the entire package for a cluster of plural, like containers such as bottles. The sheet circumferentially envelopes the cluster with the ends of the sheet overlapping at the alignment of one of the longitudinal ends of the clustered containers.

Shelton, U.S. Pat. No. 4,177,895 is directed a package comprising a multi-cell container prepared from a partially corrugated first material having peaks and flutes, a polymeric film encompassing the outermost peripheral surface of said container and a cover for said container and which cover is prepared from at least a partially corrugated second material having peaks and flutes.

SUMMARY OF THE INVENTION

The present invention is directed to a packaged product for shipping, which comprises a carton including a perfumed article or other volatile ingredient in the product and a shrinkwrap surrounding the carton(s) which shrink wrap includes at least three holes to vent a portion of the perfume or other volatile components from the packaged product. Preferably the holes are disposed in an array comprising at least two columns of holes and at least two generally perpendicular (to the columns) rows of holes. In a particularly advantageous embodiment, the carton is present with multiple cartons as a container mass and the container mass rather than the individual cartons is enveloped by the shrink wrap. The container mass has a periphery and a carrier wall may be disposed along that periphery. The carrier wall may include two edges which are spaced from each other and do not overlap, whereby to leave uncovered by the carrier wall a portion of the periphery of the container mass for viewing of the cartons.

The presence of the venting holes in the shrinkwrap according to the invention permits the scented articles to vent volatiles such as perfumes, which can permeate and stain the exterior of paperboard cartons and/or discolor the printing inks on the carton. By placing holes in the film, especially prior to shrinkwrapping, excess volatiles can escape from the tray pack and carton staining or ink discoloration is substantially or completely avoided.

It is especially preferred that the films used for shrink wrapping include arrays of circular holes spaced from other holes in the row or column at from two inches to eight inches apart. The holes may advantageously have diameters within the range of ⅛ inch to 1 inch, although smaller or larger holes may be useful in particular applications. It will be appreciated that the size and positions of the holes in the final package may be the same or may change during shrinkwrapping. Since there is more shrinkage in the machine direction when the film is exposed to heat, it has been observed the initially round holes may become ovalized and somewhat larger in the final, tight shrink wrap around the cartons.

The holes should be made at the closest practical spacing and with the largest practical hole size for the shrink film. The spaces and hole size can, however, be adjusted to accommodate different levels of product volatility.

Although the invention is especially useful for perfumed articles, it may also be used for products including other volatile components. A particularly preferred use of the invention is for fabric softener sheet cartons.

The product containers and optional carrier wall are preferably shrink wrapped together so as to form a unitary packaged product. The shrink wrap helps keep the individual containers in place whereas the carrier wall provides compressive, topload strength and protects the containers on several sides of the periphery to minimize substantially the likelihood that the containers will be damaged in transit. The preferred spacing of the two free ends of the carrier wall from each other permits at least a portion of the container or containers along the periphery to be viewed from outside the package. Moreover, in a preferred embodiment, the top and the bottom edges of the carrier wall are unattached, so the top and bottom of the container are open and may be viewed freely through the shrink wrapping.

Preferably, the containers occupy the entire volume inside the carrier wall whereby to minimize the likelihood of damage to any of the containers. In its preferred form, the containers of the invention are cartons and the carrier wall takes the form of a plurality of panels which are not curved and which snugly accommodate the containers within.

It is preferred that the portions of the carrier wall which are adjacent the periphery of the container faces be coextensive with those faces. That is, it is preferred that the height of the carrier wall be approximately the same as (perhaps slightly larger than) the height of the periphery of the container mass. Most preferably, the cartons occupy slightly less than the height of the carrier wall.

For a more complete understanding of the above and other features and advantages of the invention, reference should be made to the following detailed description of preferred embodiments and to the accompanying drawings.

DETAILED DESCRIPTION OF THE INVENTION

Figure 1:
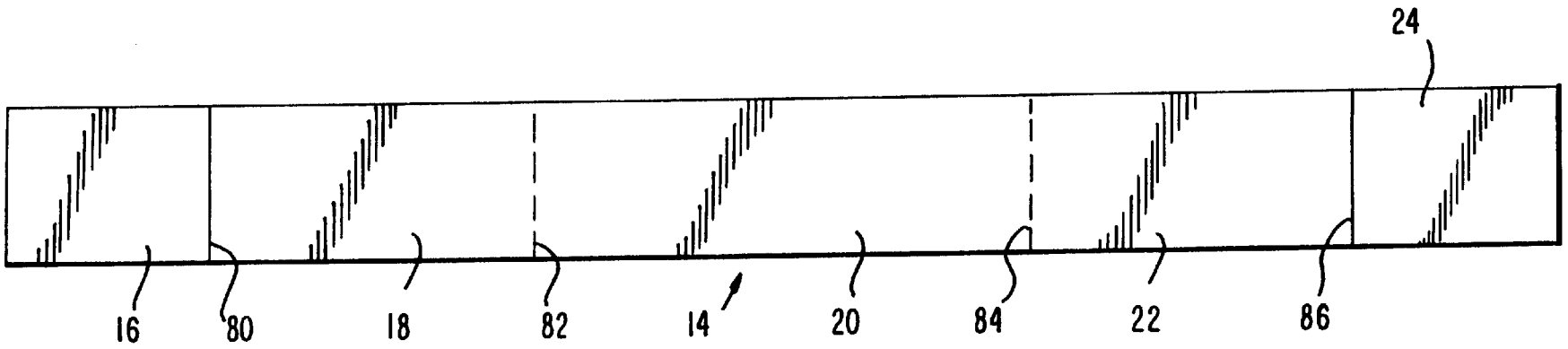
FIG. 1 is a top plan view of a blank which may be used to fabricate the carrier wall which may be used in the invention.

The package of the invention 10 comprises individual containers such as cartons 12. Cartons 12 are packed together to form a container mass. The container mass is surrounded on its periphery by carrier wall 14 which is preferably made of a corrugated board material. The periphery may comprise, for example, a side of the container mass, as shown.

Carrier wall 14 comprises panels 16, 18, 20, 22 and 24 separated by scorelines 80, 82, 84 and 86. Preferably, as shown, edges 26 of panel 24 and 28 of panel 16 do not meet and do not overlap whereby to leave a portion of the periphery of the container mass 30 uncovered by the carrier wall so that the product may be viewed externally of the package. In addition, it is preferred that the top edge 32 and the bottom edge 34 of the carrier wall be free from attachments. Thus, both the top and the bottom of the package are open and can be viewed from without the package.

The package including individual containers is wrapped in shrink wrap 36 which preferably envelopes at least 60% of the surface area of the package, especially at least 85%.

The heat shrinkable material may comprise any of the uniaxially or biaxially oriented polymeric films which upon application of heat are shrunk to a decreased surface area. Suitable films include oriented polyolefinic films such as polyethylene, polypropylene, polyisopropylethylene and polyisobutylethylene. Other films which may be useful are polyvinyl chloride, polyethylene terepthalate, polyethylene-2,6-napthalate, polyhexamethylene adipamide, as well as polymers of alpha mono-olefinically unsaturated hydrocarbons having polymer producing unsaturation such as butene, vinyl acetate, methylacrylate, 2-ethyl hexyl acrylate, isoprene, butadiene acrylamide, ethylacrylate, N-methyl-n-vinyl acetamide, etc. Many other films may be successfully employed as well. Polyolefin, preferably biaxially oriented polyethylene, is preferred.

Shrink wrapping is well known to manufacturers of consumer products. Appropriate films and processes for shrink wrapping are described in the Wiley Encyclopedia of Packaging Technology, Marilyn Bakker, Editor in Chief, John Wiley and Sons, copyrighted 1986, pgs. 335–338 ("Films, Shrink 708 to 712 ("Wrapping Machinery, Shrink Film"), and page 158 ("Tray Former/Loader"), which pages are hereby incorporated by reference herein.

The thickness of the film used in the shrink wrapping according to the present invention preferably ranges from 0.5 to 4 mils in thickness, especially from 1 to 3 mils thickness, most preferably from 1.5 to 2 mils thickness. Huntsman X540 film available from Huntsman Packaging Corporation of Salt Lake City, Utah has been found to be suitable. Huntsman X540 film is a blend of HDPE & LDPE.

The holes would be punched into the shrinkwrap film in a secondary operation between rotary punching and cushioning rolls. Round discs of punched film would be discarded leaving the vent holes.

Figure 2:
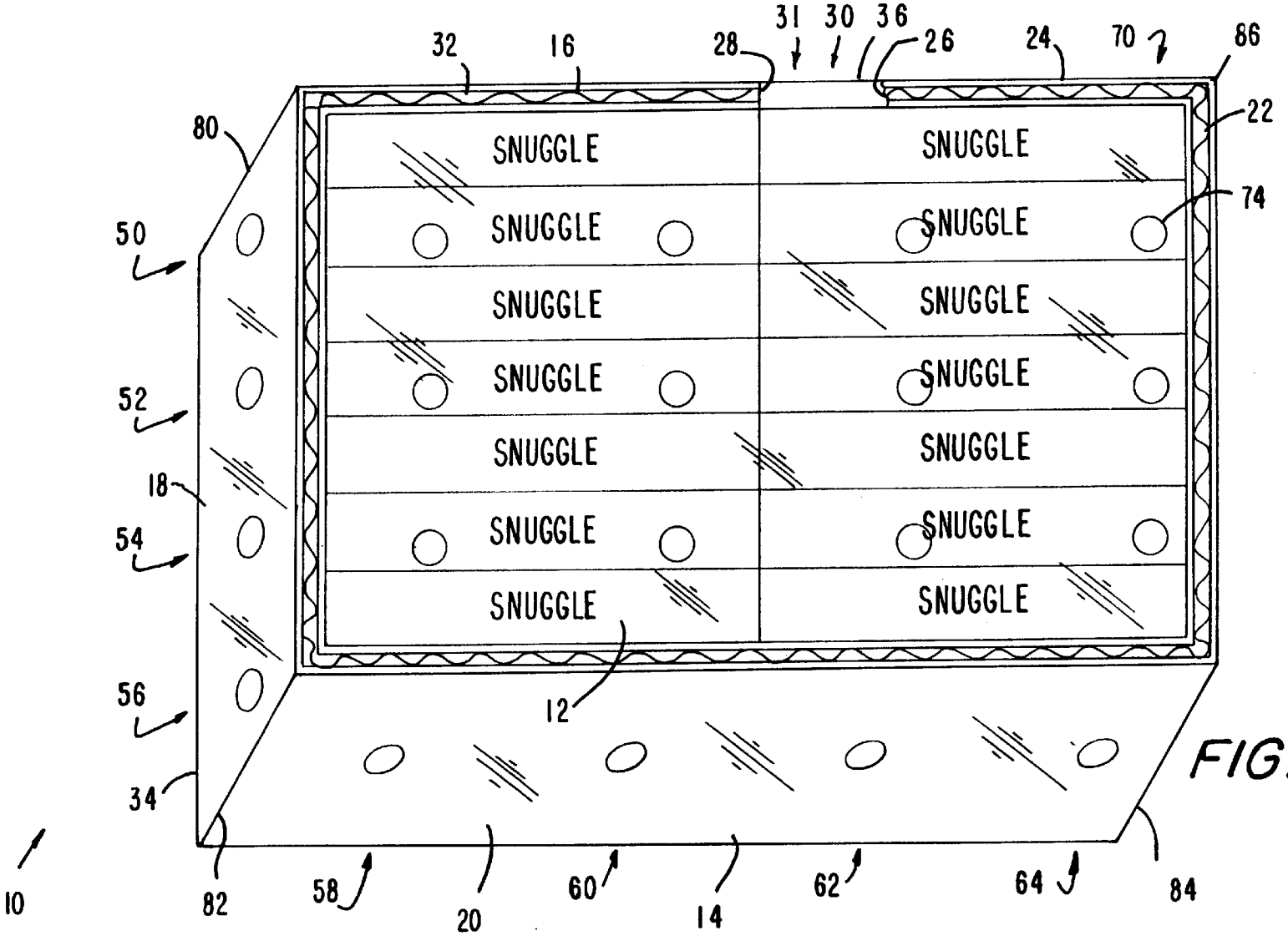
FIG. 2 is a perspective view of the package of the invention.

It can be seen that the carrier wall protects containers 12 along the side of the container mass while leaving the top and the bottom (not shown) free for observation by a consumer or others. Likewise, a portion of the periphery may be seen where the edges 26, 28 do not overlap, at 31. Moreover, as seen in FIG. 2, the flutes of the corrugated paperboard are preferably disposed vertically so as to improve the ability of the carton to withstand forces imposed above and below. This is especially important where cartons are stacked one upon the other and the carrier wall provides the containers with further protection in this respect.

It is preferred that the package of the invention contain cartons housing fabric softener sheets; however the package may be useful for containers of other types of consumer and other products. Products for which the container may be used include powdered laundry detergent cartons, liquid laundry detergent cartons, liquid fabric softeners cartons, powdered automatic dishwashing detergent cartons, hand dishwashing cartons, soap and other surfactant bar cartons, and liquid soap cartons just to name a few.

Suitable cartons for fabric softener sheets are described in Chesson et al., U.S. Pat. No. 5,577,612 and Caldwell et al., U.S. Pat. Nos. 5,305,881 and 5,310,057, the disclosures of which are hereby incorporated by reference. Fabric softener sheets and materials for use therein are described in Rudy et al., U.S. Pat. Nos. 4,421,792, 4,327,133, 4,238,531, 4,012,326 and 3,972,131, the disclosures of which are incorporated herein by reference.

It is preferred that the containers occupy approximately 98–100% of the internal volume of the carrier wall. This permits the package to provide the optimum protection to the containers.

The bottom perspective view of the package 10 will resemble the top perspective view seen in FIG. 2.

It is preferred that the containers not extend above the height of the carrier wall to optimize protection for the containers. Indeed it is preferred that the top and bottom of the carrier wall be level with or just slightly above the tops and bottoms of the containers. The package of the invention permits adequate support and protection for the containers without the addition of further features. That is the carrier wall as described and the shrink wrap is all that is necessary to both support and protect the containers.

Shrink wrap 36 includes rows 50, 52, 54 and 56 and columns 58, 60, 62, 64 and 70 of holes 74. The holes permit perfumes and other volatile substances contained within cartons 12 to be vented during and after shrink wrapping of the package. Escape of volatiles permits the avoidance of carton staining or printing ink discoloration.

While the package illustrated in FIG. 2 includes an ordered array of rows and columns of the holes 74, any pattern or random positioning of the holes may be provided so long as volatiles are permitted to vent from within the shrink wrap. Particularly when exposed to a wide range of temperatures, especially ambient and higher, the vented shrink film provides a means of escape for fugitive volatiles before they concentrate and discolor and stain the cartons. Also, changes in printed ink colors, which are known to have occurred as a result of perfume build up, are avoided. The hole size and hole spacing can be adjusted to fit the venting needs of different products and packages.

By volatiles herein is meant product components that can vaporize and pass through the carton walls. The transient vapors can stain the exterior of the paperboard carton or discolor the printing inks.

It is understood that the holes which are present in the films used to shrink wrap the package according to the invention may become distorted during shrink wrapping so that size and position of the holes may change.

The vent holes are preferably punched into the shrink film in a secondary manufacturing process before the shrink film is shipped to a product manufacturing or packaging operation. The shrink film is then wrapped and shrunk around the package or group of packages. The holes are sufficiently sized and spaced apart to provide adequate ventilation of volatile(s) out of the carton or cartons. Vent holes differ from a "bullseye hole" or "hand hole" on either side of some packs. The "bullseye" holes are formed by selecting a cross-direction shrink film width that is purposely narrow so that the "bullseye holes" will be created in the final shrink-wrapped package. "Bullseye holes" are located over corrugated board on the sides of the tray either for cost savings of material or to provide handholes for carrying.

It should be understood, of course, that the specific forms of the invention herein illustrated and described are intended to be representative only as certain changes may be made therein without departing from the clear teachings of the disclosure. Accordingly, reference should be made to the following appended claims in determining the full scope of the invention.

What is claimed:

1. A packaged product comprising:

a) a carton comprising a perfumed article, b) a shrink wrap surrounding said carton, c) said shrink wrap including at least three holes positioned to vent a portion of said perfume or other volatile component from said packaged product, wherein said article is selected from the group consisting of fabric softener sheets, powdered detergent, and personal washing bars.

2. The packaged product according to claim 1 wherein said article is a fabric softener sheet.

3. The packaged product according to claim 1 wherein said article is a powdered detergent.

4. The packaged product according to claim 1 wherein said article is a personal washing bar.

5. The packaged product according to claim 1 wherein hole size ranges from 1 mm to 1 inch in diameter and the holes are spaced from 2 inches to 12 inches apart.

6. A packaged product comprising:

a carton comprising a perfumed article or other volatile component, a shrink wrap surrounding said carton, said shrink wrap including at least three holes positioned to vent a portion of said perfume or other volatile component from said packaged product, wherein a) a plurality of individual said cartons are packed together to form a container mass, b) said container mass has a periphery, c) a paperboard carrier wall is disposed along a portion of the periphery of said container mass and covering a portion of said periphery, said shrink wrap enveloping said container mass and said carrier wall.

7. The packaged product according to claim 6 wherein a) said wall has two free ends spaced from each other so as to leave a portion of said periphery uncovered by said wall, said edges not overlapping, and b) said containers are fully supported by said shrink wrap and said carrier wall and whereby the portion of said periphery uncovered by said wall is visible outside said packaged product.

8. The packaged product according to claim 1 wherein said wall is made of corrugated board or paperboard.

9. The packaged product according to claim 6 wherein said carrier wall comprises a plurality of panels.

10. The packaged product according to claim 6 wherein said container mass periphery is rectangular or square and said carrier wall comprises a plurality of panels.

11. The packaged product according to claim 6 wherein the container mass periphery has a height and the container wall has a height and the heights of the container mass periphery and of the container wall are approximately the same.

12. The packaged product according to claim 7 wherein said cartons contain fabric softener sheets.

13. The packaged product according to claim 12 wherein said cartons are six-sided.

14. The packaged product according to claim 7 wherein said two free ends of said carrier wall are side edges and where said carrier wall has a top edge and a bottom edge, said top and bottom edges also being free of attachment.

15. A packaged product comprising:

a) a carton comprising an article selected from the group consisting of fabric softener, detergent, and personal washing product, b) said article including a volatile component, c) a shrink wrap surrounding said carton, d) said shrink wrap including at least three holes, positioned to vent a portion of said volatile component from said packaged product.

16. The packaged product according to claim 15 wherein said article is a fabric softener sheet.

17. The packaged product according to claim 15 wherein said article is a powdered detergent.

18. The packaged product according to claim 15 wherein said article is a personal washing bar.

19. The packaged product according to claim 15 wherein:

a) a plurality of individual said cartons are packed together to form a container mass, b) said container mass has a periphery, c) a paperboard carrier wall is disposed along a portion of the periphery of said container mass and covering a portion of said periphery, said shrink wrap enveloping said container mass and said carrier wall.

20. The packaged product according to claim 19 wherein a) said wall has two free ends spaced from each other so as to leave a portion of said periphery uncovered by said wall, said edges not overlapping, and b) said containers are fully supported by said shrink wrap and said carrier wall and whereby the portion of said periphery uncovered by said wall is visible outside said packaged product.

21. The packaged product according to claim 15 wherein said wall is made of corrugated board or paperboard.

22. The packaged product according to claim 19 wherein said carrier wall comprises a plurality of panels.

23. The packaged product according to claim 19 wherein said container mass periphery is rectangular or square and said carrier wall comprises a plurality of panels.

24. The packaged product according to claim 19 wherein the container mass periphery has a height and the container wall has a height and the heights of the container mass periphery and of the container wall are approximately the same.

25. The packaged product according to claim 20 wherein said cartons contain fabric softener sheets.

26. The packaged product according to claim 19 wherein said cartons are six-sided.

27. The packaged product according to claim 20 wherein said two free ends of said carrier wall are side edges and where said carrier wall has a top edge and a bottom edge, said top and bottom edges also being free of attachment.

* * * * *